United States Patent [19]

Kobayashi

[11] 4,343,556

[45] Aug. 10, 1982

[54] INK RIBBON CARTRIDGE

[75] Inventor: Takao Kobayashi, Shiojiri, Japan

[73] Assignee: Shinshuseiki Kabushiki Kaisha, Nagano, Japan

[21] Appl. No.: 200,184

[22] Filed: Oct. 24, 1980

[30] Foreign Application Priority Data

Oct. 26, 1979 [JP] Japan ..... 54-138545

[51] Int. Cl.[3] ..... B41J 33/26; B41J 33/10; B41J 32/02

[52] U.S. Cl. ..... 400/196.1; 400/228; 400/235.1; 226/181

[58] Field of Search ..... 400/194–196.1, 400/228, 235.1; 226/181–187

[56] References Cited

U.S. PATENT DOCUMENTS

| | | | |
|---|---|---|---|
| 3,871,507 | 3/1975 | Perry et al. | 400/235.1 X |
| 3,974,906 | 8/1976 | Lee et al. | 197/168 |
| 3,980,171 | 9/1976 | Frechette | 400/235.1 X |
| 3,981,387 | 9/1976 | Gottschlich | 197/168 |
| 4,131,372 | 12/1978 | Hengelhaupt | 400/196.1 |

FOREIGN PATENT DOCUMENTS

| | | | |
|---|---|---|---|
| 2230096 | 1/1974 | Fed. Rep. of Germany | 226/181 |
| 379041 | 8/1964 | Switzerland | 226/181 |

*Primary Examiner*—Paul T. Sewell
*Assistant Examiner*—Daniel J. Roock
*Attorney, Agent, or Firm*—Blum, Kaplan, Friedman, Silberman & Beran

[57] ABSTRACT

An ink ribbon cartridge for a printer drives an endless loop of ribbon by passing the ribbon between a feed roller having teeth of one pitch and a pinch roller having teeth of another pitch.

21 Claims, 7 Drawing Figures

FIG. 1
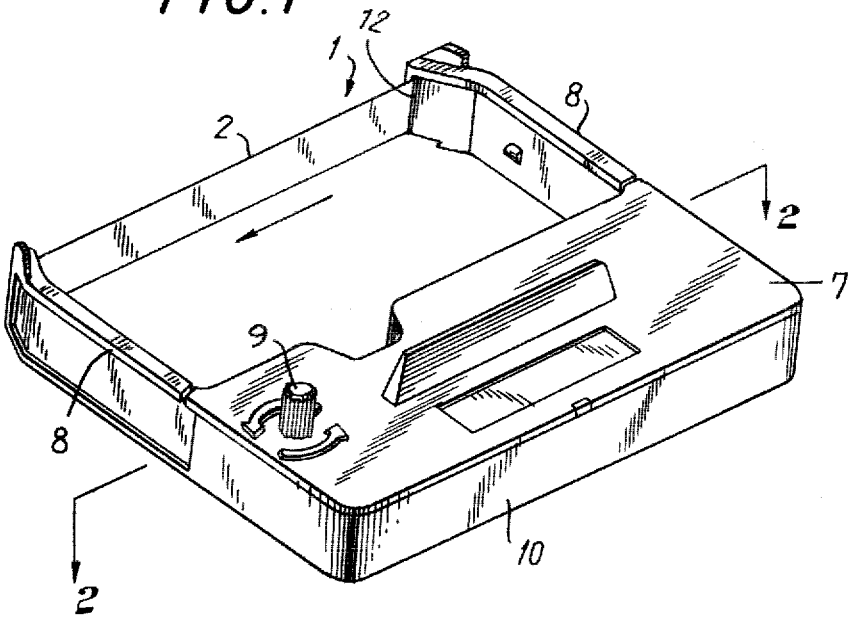
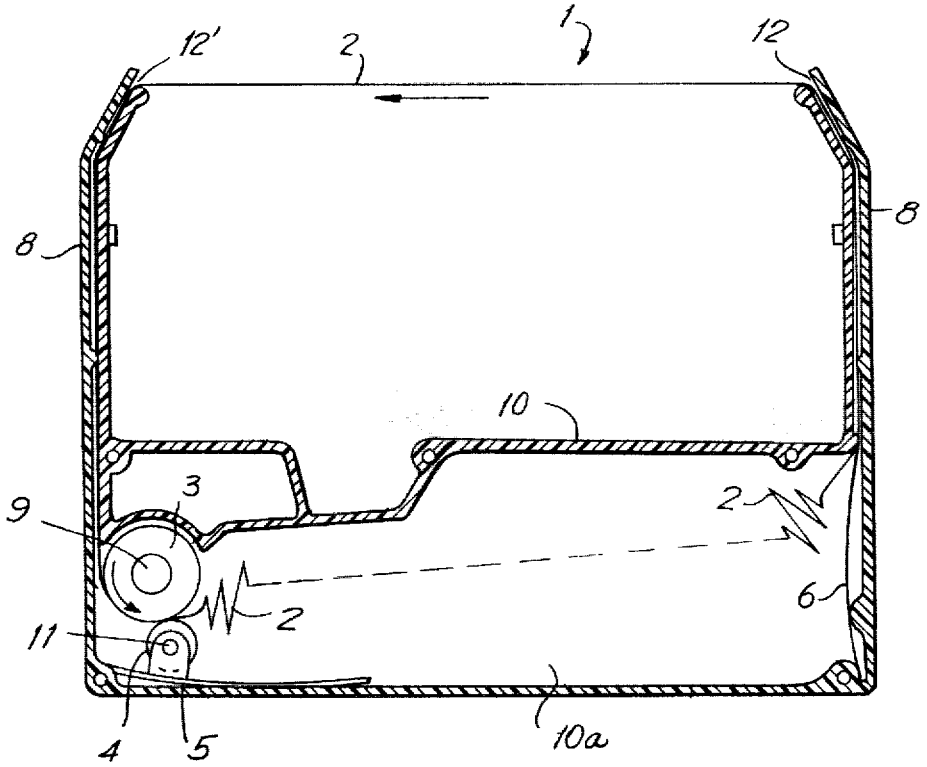
FIG. 2

INK RIBBON CARTRIDGE

BACKGROUND OF THE INVENTION

This invention relates generally to an ink ribbon cartridge of the type used in printers and typewriters and more particularly to ink ribbon cartridge providing a continuous loop of ribbon which feeds out from one side of the cartridge and returns to the cartridge after being used for printing. In ink ribbon cartridges of the prior art, there are problems, for example, a spot of printed matter appears unintentionally at the time of printing characters on a recording paper because the ink ribbon has become creased and wrinkled while stored in the cartridge case. Further, if the ink ribbon is stored in small folds or loops, the quantity of ink ribbon which can be stored in a case becomes small and it is necessary to enlarge the case to obtain storage for the required length of ink ribbon. Such problems can be resolved if the ink ribbon is stored in the case in an orderly fashion and the folds or loops in the ribbon are large.

In the prior art a rubber band is attached to the feed roller and pinch roller between which the ink ribbon is positioned. This helps to overcome the storage problems described above. However, such an ink ribbon cartridge mechanism has several disadvantages related to the characteristics of control provided by the rubber band, the increase in the number of production steps for inserting and attaching the rubber band to the feed roller and the pinch roller, the need to control the force applied by the rubber band to the feed roller and pinch roller, and so on. These added difficulties raise questions of product reliability and also increase the cost of production.

What is needed is an ink ribbon cartridge which stores a large quantity of ribbon in a relatively small case and transmits the ribbon for printing without wrinkles which can cause the printed matter to be marred in appearance.

SUMMARY OF THE INVENTION

Generally speaking, in according with the invention, an ink ribbon cartridge especially suitable for use in printing on a recording paper is provided. The ink ribbon cartridge drives an endless loop by passing the ribbon between a feed roller having teeth of one pitch and a pinch roller having teeth of another pitch. The ribbon travels in only one direction, always leaving the storage casing at one side and returning at the other side after passing between a printing head and the print recording paper. Either the feed roller or the pinch roller can have the greater gear module. The inequality in gear modules causes the ribbon to form large open loops or folds within the casing and to arrange itself in an orderly manner such that a larger quantity of ink ribbon may be stored in a given casing than in the cartridges of the prior art.

Accordingly, it is an object of this invention to provide an improved ink ribbon cartridge having a simple structure, few components, low cost and high reliability.

Another object of this invention is provide an improved ink ribbon cartridge which does not cause damage to the ink ribbon in the process of driving and taking up of the ribbon.

A further object of this invention is to provide an improved ink ribbon cartridge wherein ribbon returning from a printer head is stored in an orderly fashion in open loops of extended length.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a top perspective view of an ink ribbon cartridge in accordance with this invention;

FIG. 2 is a top sectional view taken along the line 2—2 of FIG. 1;

DESCRIPTION OF THE PREFERRED EMBODIMENTS

Figure 4:
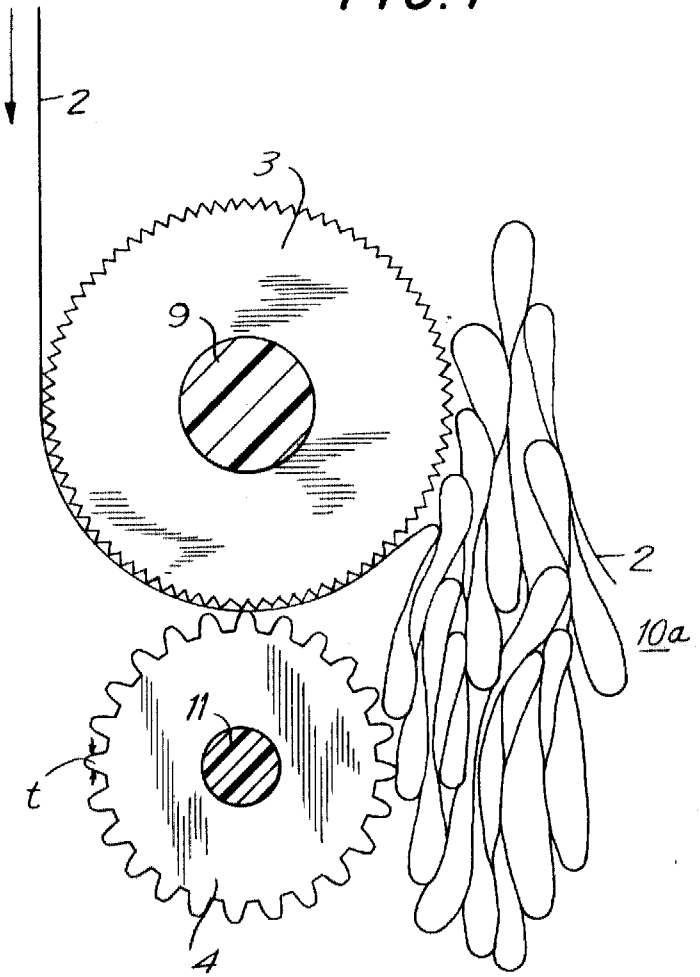
FIG. 4 is a top view to an enlarged scale of a ribbon drive in accordance with this invention.

With reference to FIGS. 1 and 2, the ink ribbon cartridge 1 in accordance with this invention includes a case 10 for storage of ink ribbon 2 in an inner compartment volume 10*a*. A pair of guide arms 8 extends substantially parallel from opposite sides of the case 10, as is explained more fully hereinafter. The ribbon 2 is drawn from a slot 12 at the end of the right guide arm 8 (FIG. 2) and enters a slot 12' at the end of the left guide arm 8. As best seen in FIG. 2, the slots 12, 12' lead to elongated narrow channels in the guide arms 8 which connect to the inner compartment 10*a*. Thus, the ribbon 2 is continuously circulated in an endless loop, being drawn from the inner compartment 10*a* through the slot 12 and returning to the inner compartment 10*a* through the slot 12'.

A feed roller 3 located within the inner compartment 10*a* is fixedly attached to a shaft 9 which, as seen in FIG. 1, protrudes from the case 10. In a printer or typewriter, the shaft 9 is rotated in one direction by means of a gear/motor drive (not shown) such that the feed roller 3 rotates.

Aslo, within the inner compartment is a pinch roller 4 mounted for rotation on a shaft 11. The ink ribbon 2 enters the compartment 10*a* through the left guide arm 8 (FIG. 2), engages the peripheral surface of the feed roller 3 and passes between the feed and pinch rollers 3, 4. Thus, by rotation of the feed roller 3, the ink ribbon 2 is driven such that it is drawn from the right side of the inner compartment 10*a* and returns at the left side.

The pinch roller 4 is held in position by a hold-down lever 5 which flexible spring characteristics. A friction load is applied to the ink ribbon 2 by means of a spring brake 6 disposed proximate the outlet of the inner compartment 10a so that the ribbon 2 is in tension across the external gap between the guide arms 8. An upper cover 7 provides a closure for the case 10 and completes the inner compartment 10a. Inner reels for storage of unused ribbon and for take-up of returning ribbon are not used in this design.

Figure 3:
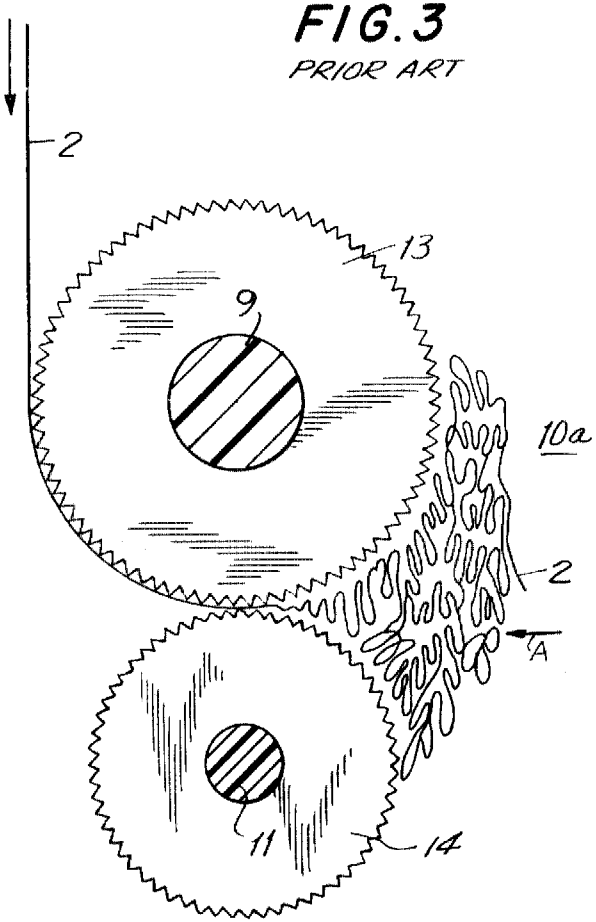
FIG. 3 PRIOR ART
FIG. 3 is a top view, to an enlarged scale of a ribbon drive of the prior art.
Figure 6:
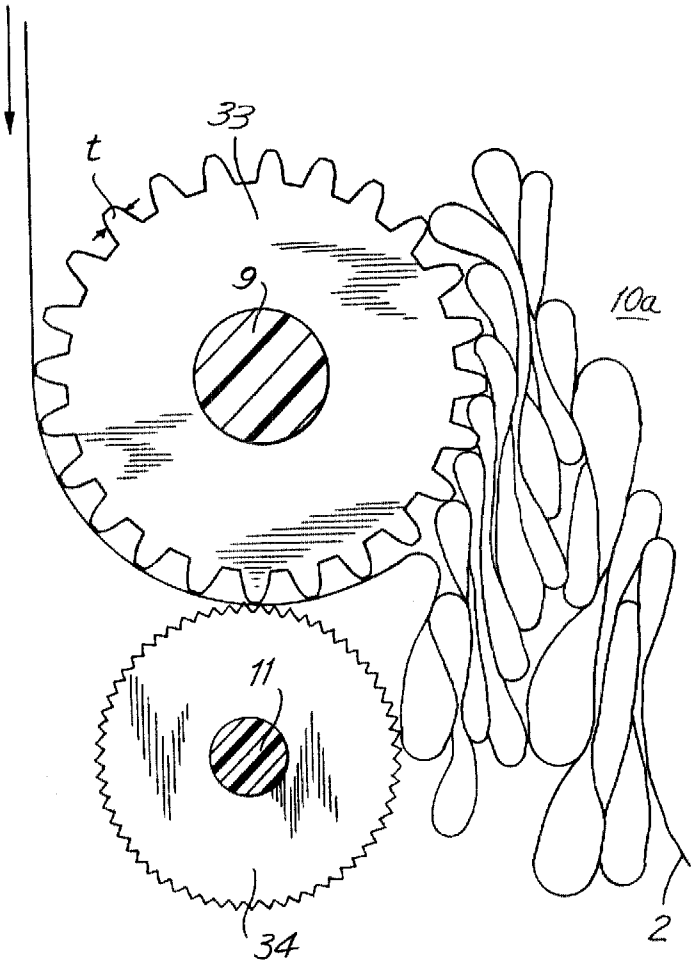
FIG. 6 is a top view to an enlarged scale of another alternative embodiment of a ribbon drive in accordance with this invention.

FIG. 3 shows a generalized combination of feed roller 13 and pinch roller 14 as frequently used in the prior art. Both rollers have the same tooth form on their peripheral surfaces, that is, a triangular tooth produced by a knurling tool and having a module of approximately 0.1 to 0.3. The module is defined as the pitch circular diameter divided by the number of teeth on the roller or gear. When using an ink ribbon cartridge having a mechanism as shown in FIG. 3 for driving, the ink ribbon 2 will be stored in an orderly fashion with regular bends in the ribbon when there is sufficient room in the ink ribbon storage compartment, that is, in a compartment 10a. However, when the inner compartment 10a is almost filled with returning ink ribbon, or if the compartment is small, a load resistance may build up in the direction indicated in FIG. 3 by the arrow A. Then, the ink ribbon folds in a disorderly array (FIG. 3) and the open loops or folds of ribbon 2 become small and fine and wrinkling and creasing of the ribbon occurs. These wrinkles not only have a bad effect on printing quality, but also the wrinkles cause the quality of the ink ribbon itself to be quickly diminished. Also, the wrinkles, creases and disorderly array of loops raise the work load on the feed roller 13 and many times cause a malfunction of the cartridge.

The embodiment of an ink ribbon cartridge in accordance with this invention, shown in FIGS. 4–7, eliminates these deficiencies by the construction of the feed roller and pinch roller.

FIG. 4 is a drive mechanism for an ink ribbon cartridge in accordance with this invention wherein a conventionally used triangular tooth produced by a knurling tool is applied to the feed roller 3. The module of the feed roller is less than 0.3. The pinch roller 4 has teeth with a module greater than 0.3. The teeth on the pinch roll 4 are of a modified involute profile, with the tooth thickness t being somewhat thinner than is conventional. The teeth of the two rollers 3, 4 engage with the ink ribbon 2 in between and thereby the ink ribbon is fed. As seen in FIG. 4, the ribbon 2 forms open loops of extended length which arrange themselves in the compartment 10a in an orderly fashion.

Figure 5:
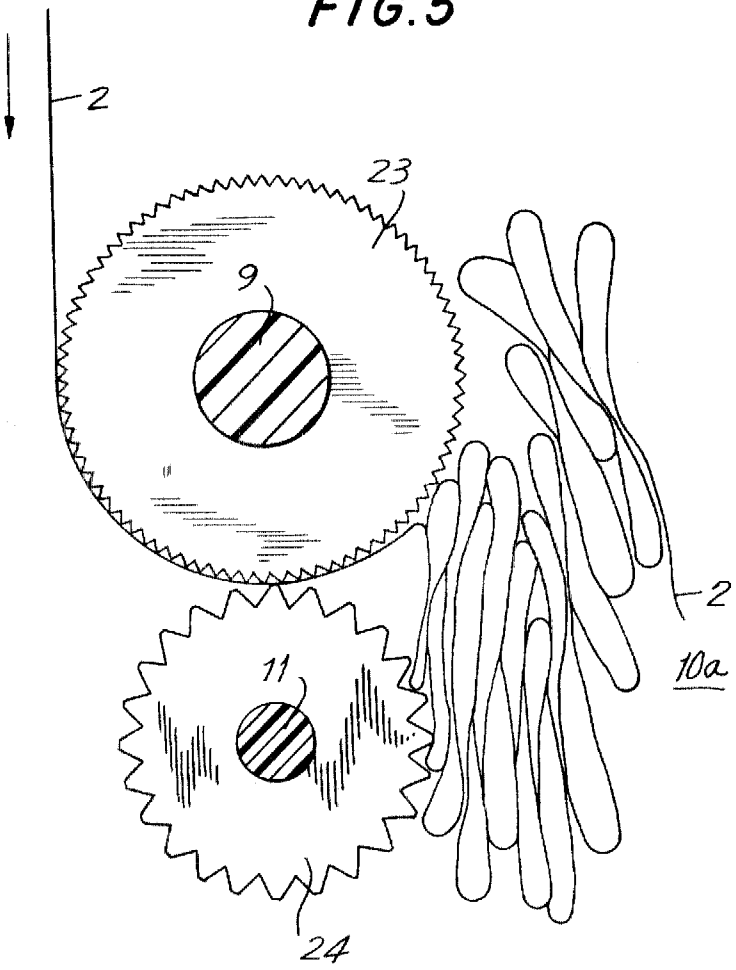
FIG. 5 is a top view to an enlarged scale of an alternative embodiment of a ribbon drive in accordance with this invention.

FIG. 5 is an alternative embodiment of the drive mechanism wherein the triangular tooth produced by knurling and having a module less than 0.3 is applied to a feed roller 23. The pinch roller 24 engaged with the feed roller 23 to drive the ribbon positioned therebetween, has a larger module than does the feed roller 23. The module of the pinch roller 24 is greater than 0.3 and the teeth are substantially triangular in profile. Ribbon loops are large and orderly.

In another alternative embodiment of the drive mechanism (FIG. 6), a pinch roller 34 includes triangular teeth as applied by a knurling tool and the gear module is less than 0.3. A pinch roller 33 has a module greater than 0.3 and the teeth of the feed roller 33 are of a modified involute profile wherein tooth thickness t is somewhat reduced so that the ends of the teeth of the feed roller can engage with the triangular teeth of the pinch roller.

Figure 7:
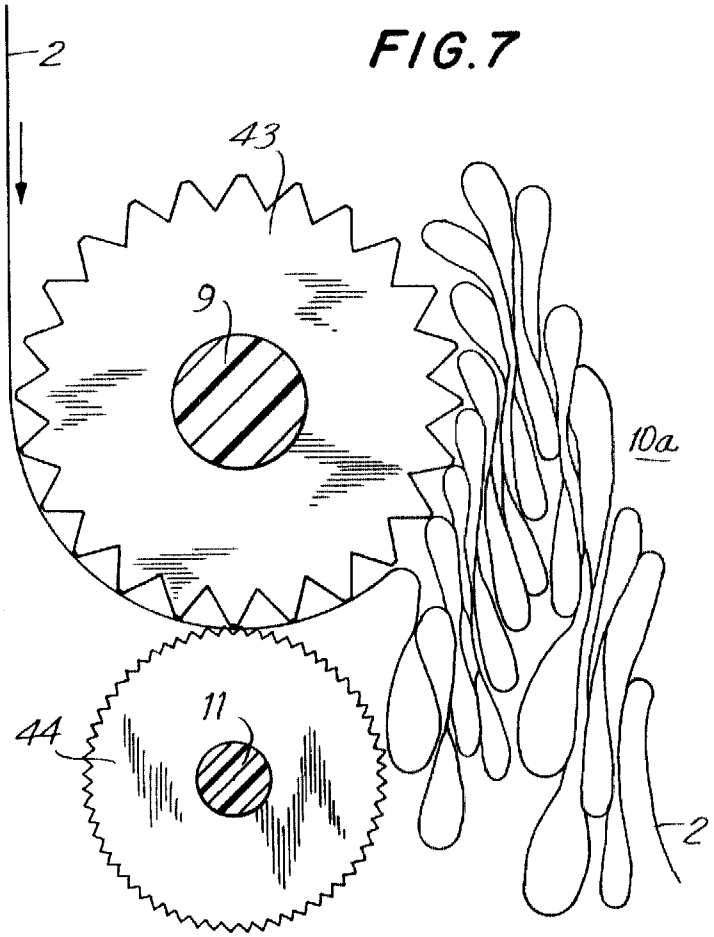
FIG. 7 is a top view to an enlarged scale of yet another alternative embodiment of a ribbon drive in accordance with this invention.

FIG. 7 is another alternative embodiment of the drive mechanism for the ink ribbon cartridge in accordance with this invention. A conventional triangular tooth as produced by knurling is applied on the pinch roller 44 which has a module less than 0.3. The teeth of the feed roller 43 are larger and the module is greater than 0.3. The teeth of the feed roller are generally triangular in profile so that the tips will properly engage with the teeth of the pinch roller 44.

In every embodiment in accordance with this invention (FIGS. 4–7), the open loops or folds of ribbon 2 within the inner compartment 10a are long and arrange themselves in an orderly fashion as shown. Thus, the length of ink ribbon 2 stored in the inner compartment 10a is considerably greater than the ink ribbon which can be stored in the same inner compartment 10a using the conventional feed roller 13 and pinch roller 14 of the prior art as shown FIG. 3 where both rollers have triangular teeth formed from the same knurling tool and have the same gear module.

In summary, in accordance with this invention, the tooth forms of the feed roller and the pinch roller used in moving the ink ribbon 2 are different one from the other. One of the rollers has a gear module greater than 0.3 while the other has a gear module less than 0.3. As a result, the internal loops or folds of ribbon formed within the inner compartment 10a are long and the amount of ribbon which can be stored in a given case is large as compared to a cartridge using the conventional drive mechanism of FIG. 3. Further, the internal pressures and friction on the ink ribbon within the case 10 is low and there is no unusual load placed on the feed roller or at drive shaft 9. Functional difficulties and malfunctions are reduced. Because no rubber band is used in the construction, as is frequently done in the ink ribbon cartridges of the prior art, the cartridge of the instant invention is superior in that the number of parts, cost, the number of production steps and quality control requirements are reduced. The structure is simple, reliable and provides for printing of a high quality.

The ribbon is of conventional construction and includes printing medium, e.g., ink, carbon, which is transferred to a recording medium such as paper during the printing process.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A ribbon cartridge for a printer producing characters on a recording media, comprising:

a feed roller of a first finite module mounted for rotation and having peripheral teeth of a first profile;

a pinch roller of a second finite module mounted for rotation and having peripheral teeth of a second profile, the teeth of said rollers being in engagement, said first and second modules being different;

a ribbon of extended length, said ribbon being interposed between said feed and said pinch rollers in the region of said engagement, whereby said ribbon is transported when said feed roller rotates.

2. A ribbon cartridge as claimed in claim 1, wherein the gear module of said feed roller is at least 0.3.

3. A ribbon cartridge as claimed in claim 2, wherein the gear module of said pinch roller is a range from 0.1 to 0.3 and less than the gear module of said feed roller.

4. A ribbon cartridge as claimed in claim 1, wherein the gear module of said pinch roller is at least 0.3.

5. A ribbon cartridge as claimed in claim 4, wherein the gear module of said feed roller is in a range of from 0.1 to 0.3 and less than the gear module of said pinch roller.

6. A ribbon cartridge as claimed in claim 3 or 5, wherein said roller having a module of at least 0.3 has teeth of a modified involute profile wherein the tooth thickness between leading and trailing tooth edges is reduced.

7. A ribbon cartridge as claimed in claim 6, wherein said roller of the least gear module has teeth of a triangular profile.

8. A ribbon cartridge as claimed in claim 3 or 5, wherein both of said rollers have teeth of triangular profile.

9. A ribbon cartridge as claimed in claim 3 or 5, and further comprising:

a case, said case enclosing said rollers;

a drive shaft passing through an aperture in said case and being connected to said feed roller, whereby said feed roller rotates and transports said ribbon when said shaft rotates.

10. A ribbon cartridge as claimed in claim 9, and further comprising first and second openings in said case, said ribbon when transported, passing into said case through one said opening and out of said case through the other said opening.

11. A ribbon cartridge as claimed in claim 10, wherein said ribbon is a continuous loop, substantially the entire length of said ribbon being stored in said case.

12. A ribbon cartridge as claimed in claim 3 or 5, and further comprising printing media on said ribbon, said printing media being adapted for transfer to said recording media by operation of said printer.

13. A ribbon cartridge as claimed in claim 11, and further comprising printing media on said ribbon, said printing media being adapted for transfer to said recording media by operation of said printer.

14. A ribbon cartridge as claimed in claim 12, wherein said printing media is ink.

15. A ribbon cartridge as claimed in claim 13, wherein said printing media is ink.

16. A ribbon cartridge as claimed in claim 10, and further comprising means for placing in tension the portion of said ribbon located outside of said case when said ribbon is transported.

17. A ribbon cartridge as claimed in claim 1, wherein only the tips of the teeth of the roller of the larger module engage with teeth of the roller of the smaller module.

18. A ribbon drive comprising:

a feed roller of a first finite module mounted for rotation and having peripheral teeth of a first profile;

a pinch roller of a second finite module mounted for rotation and having peripheral teeth of a second profile, the teeth of said rollers being in engagement, said first and second modules being different;

a ribbon of extended length, said ribbon being interposed between said feed and said pinch rollers in the region of said engagement, whereby said ribbon is transported when said feed roller rotates.

19. A ribbon drive as claimed in claim 18, wherein the gear module of said feed roller is at least 0.3 and the gear module of said pinch roller is in a range from 0.1 to 0.3 and less than the gear module of said feed roller.

20. A ribbon drive as claimed in claim 18, wherein the gear module of said pinch roller is at least 0.3 and the gear module of said feed roller is in a range of 0.1 to 0.3 and the gear module of said feed roller is less than the gear module of said pinch roller.

21. A ribbon drive as claimed in claim 18, wherein only the tips of the teeth of the roller of the larger module engage with teeth of the roller of the smaller module.

* * * * *